US009010895B2

(12) United States Patent
Nakamura

(10) Patent No.: US 9,010,895 B2
(45) Date of Patent: Apr. 21, 2015

(54) INKJET PRINTING APPARATUS

(71) Applicant: Riso Kagaku Corporation, Tokyo (JP)

(72) Inventor: Hiroyuki Nakamura, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/483,704

(22) Filed: Sep. 11, 2014

(65) Prior Publication Data

US 2015/0077453 A1 Mar. 19, 2015

(30) Foreign Application Priority Data

Sep. 18, 2013 (JP) ..... 2013-193045

(51) Int. Cl.
*B41J 29/38* (2006.01)
*B41J 2/14* (2006.01)
*B41J 2/21* (2006.01)

(52) U.S. Cl.
CPC . *B41J 2/1433* (2013.01); *B41J 2/21* (2013.01)

(58) Field of Classification Search
CPC ..... B41J 2/1433; B41J 2/2103; B41J 2/2132; B41J 2/21
USPC ..... 347/12
See application file for complete search history.

(56) References Cited

U.S. PATENT DOCUMENTS

| | | | | |
|---|---|---|---|---|
| 4,963,882 | A * | 10/1990 | Hickman | 347/41 |
| 6,883,898 | B2 * | 4/2005 | Sato | 347/40 |
| 6,896,348 | B2 * | 5/2005 | Takekoshi et al. | 347/15 |
| 8,820,891 | B2 | 9/2014 | Bansyo | |
| 2005/0243126 | A1 * | 11/2005 | Takahashi et al. | 347/40 |
| 2007/0064042 | A1 * | 3/2007 | Sugahara | 347/19 |
| 2011/0085184 | A1 * | 4/2011 | Yamazaki | 358/1.5 |
| 2011/0304667 | A1 * | 12/2011 | Lill et al. | 347/15 |

FOREIGN PATENT DOCUMENTS

JP 2011-143712 7/2011

* cited by examiner

*Primary Examiner* — Alessandro Amari
*Assistant Examiner* — Michael Konczal
(74) *Attorney, Agent, or Firm* — Greenblum & Bernstein P.L.C.

(57) ABSTRACT

A controller determines a correspondence relationship among nozzles in a plurality of nozzle arrays in each head unit so that a positional relationship among nozzles corresponding to the same pixel in each nozzle array becomes the same in all of the head units irrespective of a positional relationship between nozzles having the same number in order from one side in a main scanning direction in two nozzle arrays in each head unit.

2 Claims, 10 Drawing Sheets

INKJET PRINTING APPARATUS

BACKGROUND

1. Technical Field

The present invention relates to an ink jet printing apparatus configured to perform printing by ejecting ink to print media.

A line type ink jet printing apparatus configured to print by ejecting ink from a fixed ink jet head to a sheet while conveying the sheet has been known.

The ink jet head of the line type ink jet printing apparatus may be configured by multiple head units arranged along a main scanning direction perpendicular to a conveying direction (a sub scanning direction) of a sheet (for example, refer to Patent Document 1).

As the head unit of the above-mentioned line type ink jet printing apparatus, a head unit in which two head modules each having one nozzle array of multiple nozzles arranged along the main scanning direction are stuck to each other may be used. The two head modules are stuck such that two nozzle arrays are shifted by a half of a pitch from each other in the main scanning direction. With this configuration, a head unit capable of performing printing with high resolution can be produced easily.

Here, for the two head modules of the above head unit, different color inks may be supplied separately, whereby it becomes possible to eject two color inks from a single head unit. As a result, in an ink jet printing apparatus capable of performing color printing, the apparatus can be miniaturized by reducing the number of ink jet heads.

2. Related Art

Patent Document 1: Japanese Patent Application Publication No. 2011-143712

SUMMARY

In the above-mentioned head unit, nozzles in the two nozzle arrays which are positioned to be shifted by a half of a pitch in the main scanning direction from each other, are used to form the same pixel. For example, in the case where one nozzle array is configured to eject cyan (C) ink and another nozzle array is configured to eject magenta (M) ink, cyan ink and magenta ink corresponding to the same pixel are ejected from two nozzles positioned to be shifted by a half of a pitch in the main scanning direction from each other.

Incidentally, at the time of production of the above-mentioned head unit, when two head modules are stuck by being shifted from each other, the shift direction between the head modules may become reverse to a normal direction. Subsequently, an ink jet head may be configured such that multiple head units including such a reversely-shifted head unit and a normal head unit not shifted reversely are arranged.

Between the normal head unit and the reversely-shifted head unit, the respective positional relationships of nozzles in the two nozzle arrays corresponding to the same pixel becomes reverse to each other. Accordingly, when a thin line along the sub scanning direction with a width of one pixel formed by two colors is printed, the color tone of an edge of a thin line printed by the normal head unit becomes reverse to that of a thin line printed by the reversely-shifted head unit. As a result, the printed image quality of a thin line deteriorates.

The present invention has been achieved in view of the above problems, and an object of the present invention is to provide an ink jet printing apparatus which can suppress deterioration of the printed image quality of a thin line.

In order to attain the above object, the first feature of the ink jet printing apparatus according to the present invention includes an ink jet head including a plurality of head units each having a plurality of nozzle arrays arranged, each of which has a plurality of nozzles arranged at a predetermined pitch in a nozzle arrangement direction and which is configured to eject color inks different from one another from the nozzles, the plurality of head units being arranged in the nozzle arrangement direction; and a controller configured to control the ink jet head, wherein in each of the head units, at least one of the plurality of nozzle arrays is arranged so that a position of each of the nozzles is shifted in the nozzle arrangement direction relative to at least one of the other nozzle arrays, and wherein the controller determines a correspondence relationship among nozzles in the plurality of nozzle arrays in each of the plurality of head units so that a positional relationship among nozzles corresponding to the same pixel in each of the plurality of nozzle arrays becomes the same in all of the plurality of head units irrespective of a positional relationship among nozzles having the same number in order from one side in the nozzle arrangement direction in the plurality of nozzle arrays in each of the plurality of head units.

The second feature of the ink jet printing apparatus according to the present invention resides in that, in the head unit, an amount of shift between the nozzle arrays in which the position of each of the nozzles in the plurality of nozzle arrays is shifted from one another is a half of a pitch, and the controller, when printing a thin line with a width of one pixel on a sheet in a direction perpendicular to the nozzle arrangement direction by each of the color inks corresponding to the plurality of nozzle arrays including the nozzle array in which the position of each of the nozzles is shifted in the nozzle arrangement direction, prints by ejecting inks from each of the nozzles corresponding to pixels of the thin line and each of the nozzles on a side near to the pixels of the thin line among the nozzles corresponding to pixels adjoining one side in the nozzle arrangement direction with respect to the pixels of the thin line.

DETAILED DESCRIPTION

Hereinafter, an embodiment of the present invention will be explained with reference to drawings. The same or equivalent component and constituent element through each drawing is provided with the same or equivalent symbol. However, it should be noted that the drawings are schematic and different from the actual figures. Further, of course, portions different in relative dimensional relationship and ratio among drawings may be contained.

Further, in the embodiment shown hereinafter, apparatuses and the like are exemplified in order to materialize the technical concept of the present invention. However, the technical concept of the present invention does not specify the material, configuration, structure, arrangement, etc. of each constituent component to the followings. The technical concept of the present invention may be applied with various changes in patent claims.

Figure 1:
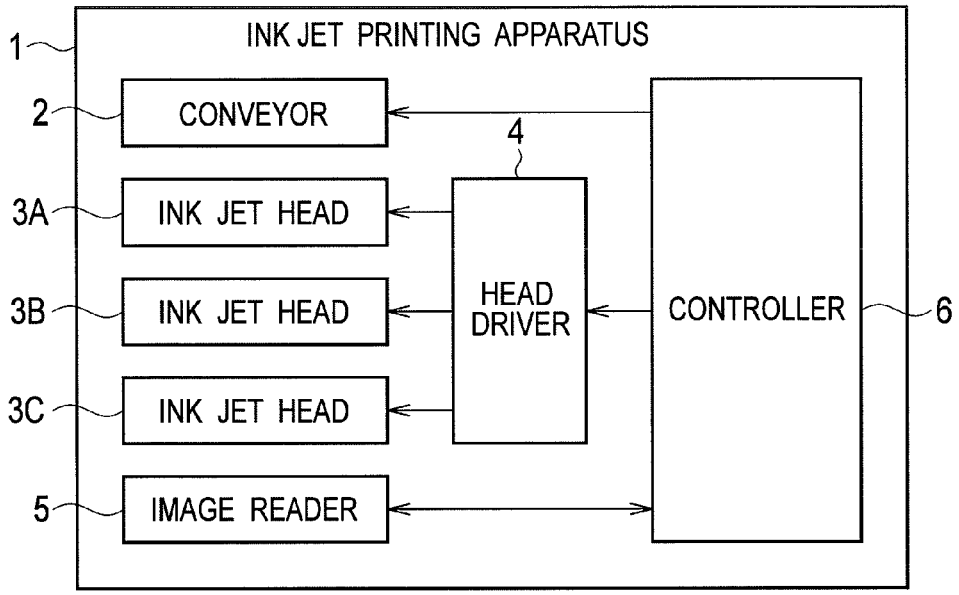
FIG. 1 is a block diagram showing the configuration of an ink jet printing apparatus according to an embodiment.
Figure 2:
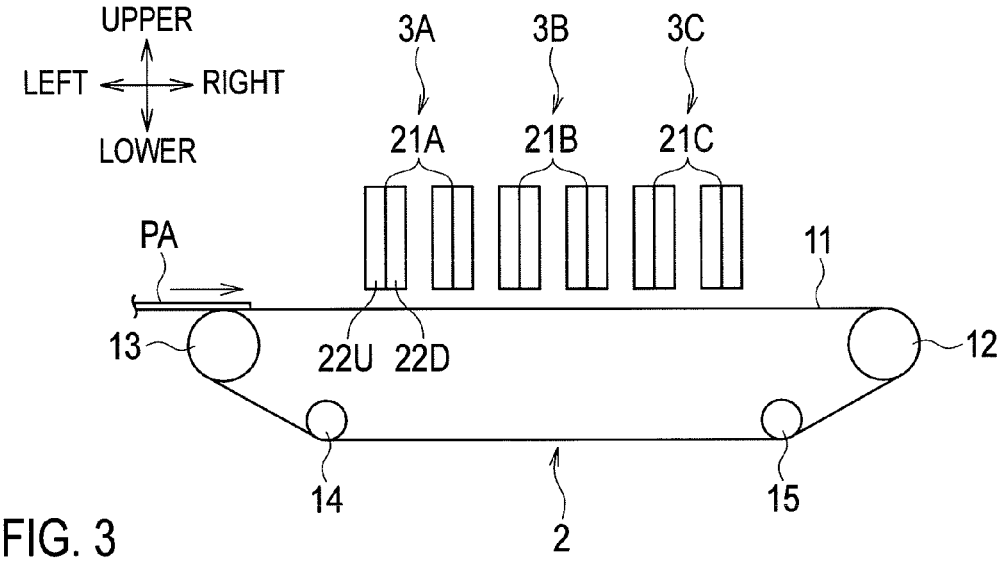
FIG. 2 is an outline configuration diagram of a conveyor and an ink jet head.
Figure 3:
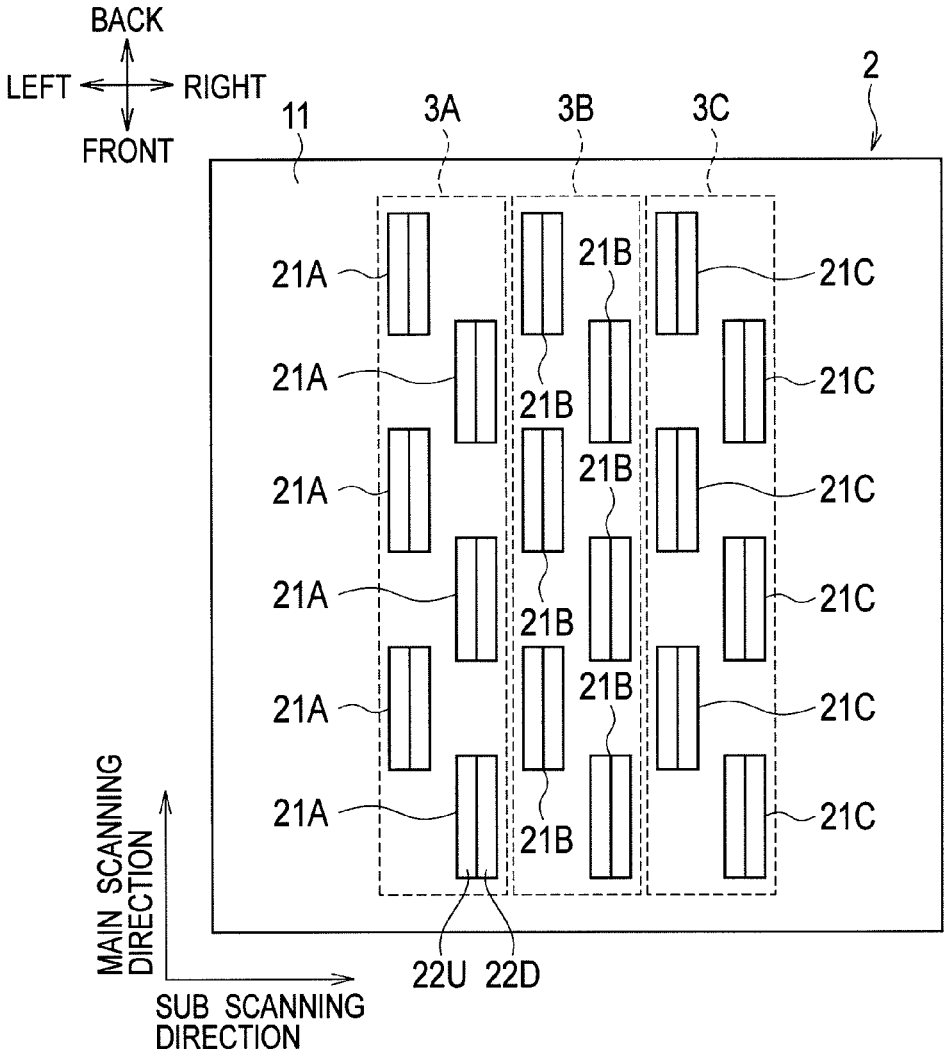
FIG. 3 is a plan view of the conveyor and the ink jet head.
Figure 4:
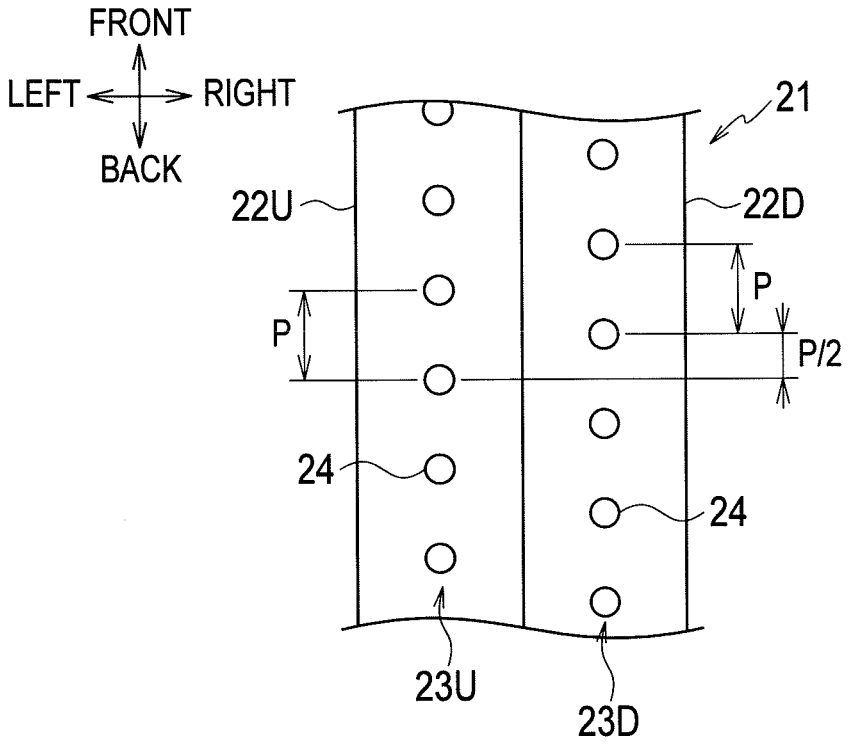
FIG. 4 is an outline configuration diagram of a head unit.

FIG. 1 is a block diagram showing the configuration of an ink jet printing apparatus according to an embodiment of the present invention. FIG. 2 is an outline configuration diagram of a conveyor and an ink jet head in the ink jet printing apparatus shown in FIG. 1. FIG. 3 is a plan view of the conveyor and the ink jet head. FIG. 4 is an outline configuration diagram of a head unit.

In the following description, a direction perpendicular to the sheet surface of FIG. 2 is made to the front-back direction, and the front direction of the sheet surface is made to the front. Further, top, bottom, left, and right on the sheet surface of FIG. 2 are made to top, bottom, left, and right directions on the ink jet printing apparatus. In FIG. 2, a direction proceeding from the left to the right is a conveying direction of a sheet PA. In the following description, upstream and downstream mean the upstream and the downstream in the conveying direction.

As shown in FIG. 1, an ink jet printing apparatus 1 according to the present embodiment includes a conveyor 2, ink jet heads 3A, 3B, and 3C, a head driver 4, an image reader 5, and a controller 6.

The conveyor 2 is configured to convey sheets PA. As shown in FIG. 2, the conveyor 2 includes a conveying belt 11, a driving roller 12, and driven rollers 13, 14, and 15.

The conveying belt 11 is adapted to adsorb and hold sheets PA and to convey them. The conveying belt 11 is an annular belt which is stretched and wound around the driving roller 12 and the driven rollers 13 to 15. On the conveying belt 11, a number of belt holes for adsorbing and holding sheets PA are formed. The conveying belt 11 is adapted to adsorb and hold sheets PA on its top surface with adsorbing power generated in the belt holes by the driving of a fan (not shown). The conveying belt 11 is adapted to be rotated in the clockwise direction in FIG. 2, thereby conveying the adsorbed and held sheets PA in the rightward direction.

The driving roller 12 rotates the conveying belt 11, and the driving roller 12 is driven by a motor which is not illustrated.

The driven rollers 13 to 15 follow the movement of the driving roller 12 via the conveying belt 11. The driven roller 13 is disposed on the left side of the driving roller 12 with the approximately same height as the driving roller 12. The driven rollers 14 and 15 are disposed below the driving roller 12 and the driven roller 13, and arranged separately from each other in the respective leftward and rightward directions with the approximately same height.

Each of ink jet heads 3A to 3C is configured to eject an ink so as to print an image on a sheet PA conveyed by the conveyor 2. The ink jet heads 3A to 3C are disposed above the conveyor 2 in this order from the upstream side, and arranged in parallel to each other with a predetermined distance in the direction (right-left direction) to convey a sheet PA.

The ink jet heads 3A to 3C include a plurality of head units 21A, a plurality of head units 21B, and a plurality of head units 21C, respectively. In the present embodiment, as shown in FIG. 3, the ink jet heads 3A to 3C include six head units 21A, six head units 21B, and six head units 21C, respectively. Here, in the symbols in the ink jet heads 3A to 3C and the head units 21A to 21C, each alphabetical suffix may be omitted so as to express the heads and units collectively.

In the ink jet head 3, the six head units 21 are arranged in a staggered arrangement along a front-back direction (main scanning direction) perpendicular to the conveying direction (sub scanning direction) of sheets PA. That is, the six head units 21 are arranged along the front-back direction, and disposed such that the respective positions of the six head units 21 are shifted in the right-left direction for every other head unit. Further, each of the head units 21 is arranged so as to overlap partially with the neighboring head unit disposed in the main scanning direction.

As shown in FIG. 4, each of the head units 21 is configured such that a head module 22U disposed on the upstream side (left-hand side) in the conveying direction of sheets PA and a head module 22D disposed on the downstream side (right-hand side) are stuck to each other.

The head modules 22U and 22D include nozzle arrays 23U and 23D, respectively. Accordingly, in the head unit 21, the two nozzle arrays 23U and 23D are arranged in parallel to each other in the right-left direction. Here, FIG. 4 is a drawing in which the head unit 21 is looked from the bottom side.

The nozzle arrays 23U and 23D include a plurality of nozzles 24 configured to eject ink fed to the head modules 22U and 22D, respectively. Each of the head modules 22U and 22D is configured such that the number of ink droplets (the number of drops) ejected from a single nozzle 24 to one pixel can be changed, whereby gradation printing adapted to express an optical density level with the number of drops can be performed. The nozzle 24 has a hole made to open on the bottom surface of the corresponding one of the head modules 22U and 22D.

In each of the nozzle arrays 23U and 23D, the nozzles 24 are arranged at equal intervals with a predetermined pitch P along the main scanning direction (front-back direction) which is a nozzle arrangement direction. Further, the nozzles 24 in the nozzle array 23U and the nozzles 24 in the nozzle array 23D are arranged so as to be shifted from each other by a half of a pitch (P/2) being a half of a pitch P in the main scanning direction. In the state that the head modules 22U and 22D are stuck to each other so as to be shifted in the main scanning direction from each other, as shown in FIG. 4, the nozzle arrays 23U and 23D are shifted from each other by a half of a pitch.

In the head module 22U of the head unit 21A of the ink jet head 3A, the nozzles 24 in the nozzle array 23U are adapted to eject black (K) ink. Also, in the head module 22D of the head unit 21A, the nozzles 24 in the nozzle array 23D are adapted to eject black ink. With this configuration, the print resolution of black can be made higher than those of the other colors.

In the head module 22U of the head unit 21B of the ink jet head 3B, the nozzles 24 in the nozzle array 23U are adapted to eject cyan (C) ink. In the head module 22D of the head unit 21B, the nozzles 24 in the nozzle array 23D are adapted to eject magenta (M) ink.

In the head module 22U of the head unit 21C of the ink jet head 3C, the nozzles 24 in the nozzle array 23U are adapted to eject yellow (Y) ink. In the head module 22D of the head unit 21C, the nozzles 24 in the nozzle array 23D are adapted to eject additional color ink. In the ink jet printing apparatus 1, the additional color is set to a color other than black, cyan, magenta, and yellow. As such an additional color, light cyan (LC), light magenta (LM), etc. may be used.

The head driver 4 is configured to drive the ink jet heads 3A to 3C. In more concrete terms, the head driver 4 drives piezoelectric elements in each of the head units 21A to 21C so as to eject ink from the nozzles 24.

The image reader 5 is configured to optically read images on a document, and to generate image data.

The controller 6 controls the operations of each section of the ink jet printing apparatus 1. The controller 6 includes a CPU, a RAM, a ROM, a hard disk, and the like.

The controller 6 determines beforehand a correspondence relation among the nozzles 24 in the nozzle arrays 23U and 23D of each head unit 21. At the time of printing operation, the controller 6 controls ink ejection from each of the nozzles 24 to each pixel based on the predetermined nozzle correspondence relation in each head unit 21. A nozzle correspondence relation determining process for determining the nozzle correspondence relation in the head unit 21 is described later.

Next, the operations of the ink jet printing apparatus 1 are described.

In the ink jet printing apparatus 1, as mentioned above, in order to determine beforehand a nozzle correspondence relation in each head unit 21, a nozzle correspondence relation determining process is performed. First, the reasons for performing the nozzle correspondence relation determining process are described.

As mentioned above, in the head unit 21, the position of each of the nozzles 24 in the main scanning direction in the nozzle array 23U is shifted by a half of a pitch from that of the corresponding one of the nozzles 24 in the nozzle array 23D. For this reason, a nozzle 24 in the nozzle array 23U and the corresponding nozzle 24 in the nozzle array 23D which are shifted from each other by a half of a pitch in the main scanning direction are used to form the same pixel.

In the normally-produced head unit 21, the head modules 22U and 22D are shifted from each other in a predetermined shift direction by a half of a pitch. In this case, nozzles 24 having the same nozzle number in the nozzle arrays 23U and 23D are used to form the same pixel. Namely, the correspondence relation among the nozzles 24 is determined such that the nozzles 24 having the same nozzle number are made to correspond to the same pixel. Here, the nozzle number shows the order of each nozzle 24 from one side in the main scanning direction in each of the nozzle arrays 23U and 23D.

Incidentally, at the time of production of a head unit 21, when the head modules 22U and 22D are shifted from each other and stuck to each other, the head modules 22U and 22D may be made to be shifted from each other by a half of a pitch in a direction reverse to a normal shift direction. Then, such a reversely-shifted head unit 21 may be included in the six head units 21 of the ink jet head 3.

Figure 5:
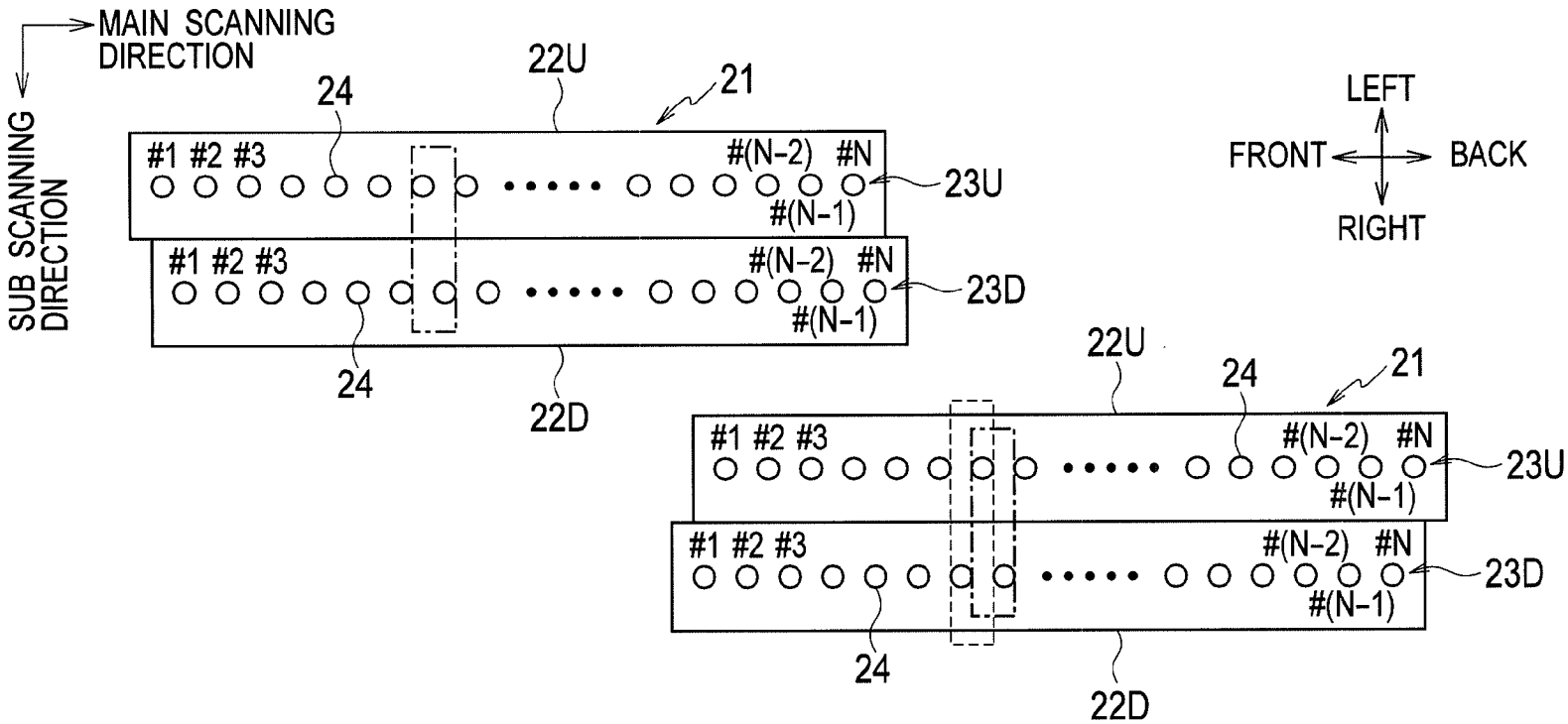
FIG. 5 is an explanatory illustration for a nozzle correspondence relation in a normal head unit and a reversely-shifted head unit.

That is, as shown in FIG. 5, in a single ink jet head 3, a normal head unit 21 and a reversely-shifted head unit 21 may be arranged to adjoin to each other.

Here, it is supposed that a direction in which an upstream side head module 22U is shifted to a front side relative to a downstream side head module 22D is set to a normal shift direction. In FIG. 5, the front side head unit 21 is a normal head unit 21, and the back side head unit 21 is a reversely-shifted head unit 21.

Here, FIG. 5 schematically shows the position of each of nozzles 24 which are looked from the upper side of the head unit 21. In each of the nozzle arrays 23U and 23D, the nozzle number is set to No. 1 (#1), No. 2 (#2), and . . . from the nozzle 24 at the front side. That is, the nozzle number represents the order of each nozzle 24 from the front side in each of the nozzle arrays 23U and 23D.

In the normal head unit 21, as mentioned above, in each of the nozzle arrays 23U and 23D, nozzles 24 having the same nozzle number are used to form the same pixel. In FIG. 5, one of combinations of nozzles 24 having the same nozzle number in the normal head 21 (the front side head unit 21) is shown by being enclosed with a one dot chain line.

In contrast to this, even in the reversely-shifted head unit 21, similarly, if nozzles 24 having the same nozzle number in each of the nozzle arrays 23U and 23D are used to form the same pixel, the positional relationship between two nozzles 24 corresponding to the same pixel becomes reverse to that of the normal head unit 21. In FIG. 5, one of combinations of nozzles 24 having the same number in the reversely-shifted head unit 21 (the back side head unit 21) is shown by being enclosed with a broken line.

In the normal head unit 21 (the front side head unit 21), in the two nozzles 24 having the same nozzle number, the upstream side nozzle 24 is located at the front side in the main scanning direction relative to the downstream side nozzle 24. In contrast to this, in the reversely-shifted head unit 21 (the back side head unit 21), in the two nozzles 24 having the same nozzle number, the upstream side nozzle 24 is located at the back side in the main scanning direction relative to the downstream side nozzle 24.

Accordingly, in the case where the normal head unit 21 and the reversely-shifted head unit 21 are mixed as shown in FIG. 5 in the ink jet head 3 configured to eject two color inks, if the nozzles 24 having the same nozzle number are used to form the same pixel in all of the head units 21, inconvenience may be caused. In more concrete terms, in the color tone of the edge on a thin line which is formed along the sub scanning direction with a width of one pixel by two colors, the color tone of the edge on a thin line printed by the normal head unit 21 becomes reverse to that on a thin line printed by the reversely-shifted head unit 21.

Figure 6:
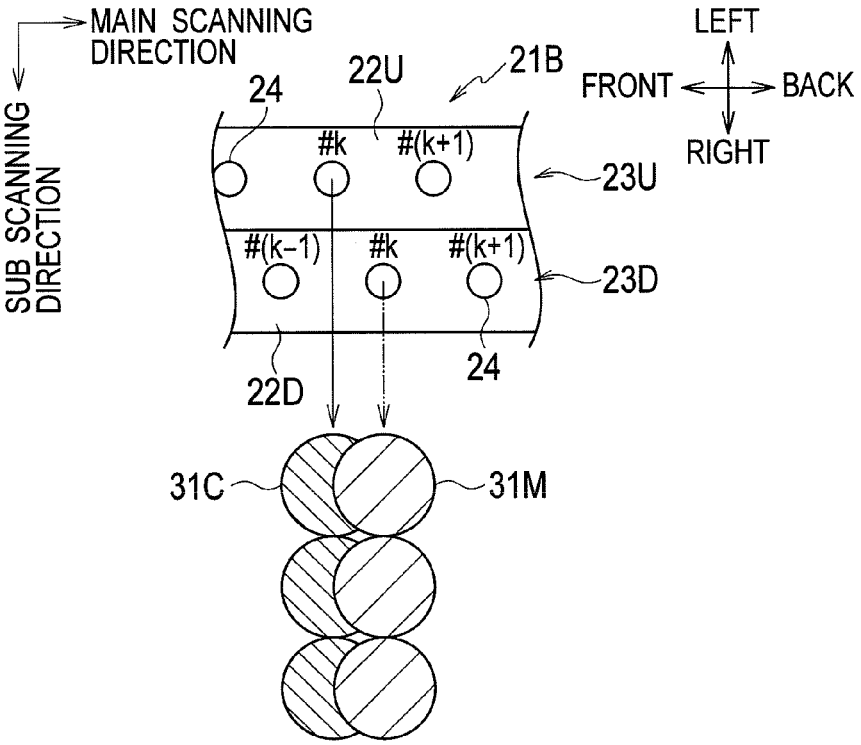
FIG. 6 is an illustration showing the dot images of a thin line with a width of one pixel formed along the sub scanning direction by two color inks ejected from the normal head unit.

For example, in the ink jet head 3B, on a thin line which is formed along the sub scanning direction with a width of one pixel by cyan and magenta inks ejected from the normal head unit 21, as shown in FIG. 6, cyan dots 31C are formed at the front side of magenta dots 31M. That is, a color tone becomes to show cyan at the front side edge of the thin line and magenta at the back side edge.

Figure 7:
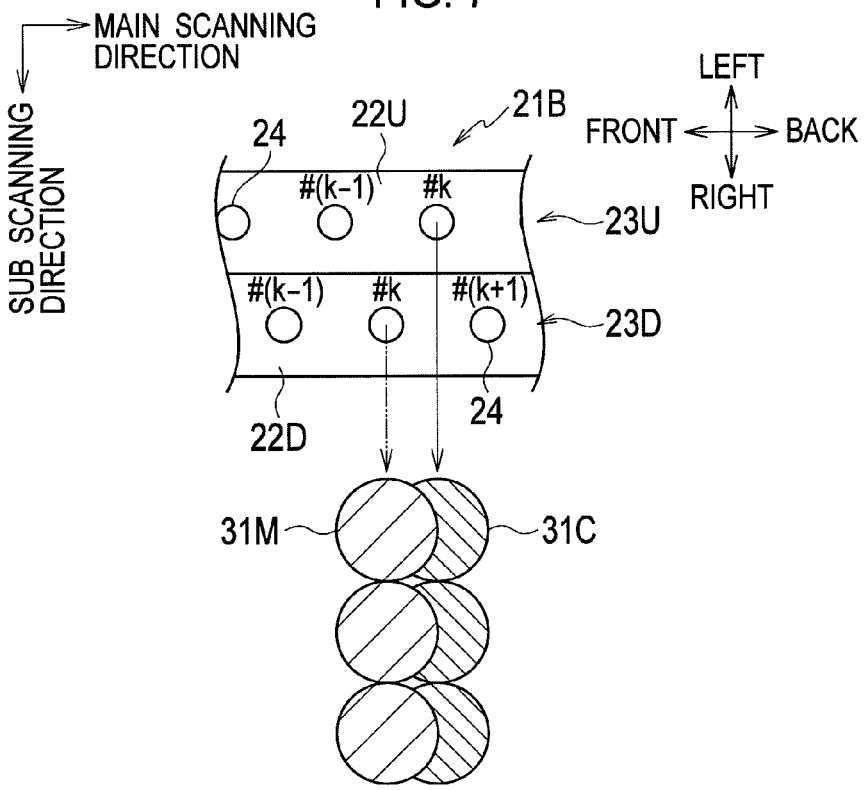
FIG. 7 is an illustration showing the dot images of a thin line with a width of one pixel formed along the sub scanning direction by two color inks ejected from the reversely-shifted head unit in the case where a nozzle correspondence relation determining process is not performed.

In contrast to this, it is supposed that the ink jet head 3B includes the reversely-shifted head unit 21 as shown in FIG. 5 and two nozzles 24 having the same nozzle number are used to form the same pixel in the reversely-shifted head unit 21. In this case, on a thin line which is formed along the sub scanning direction with a width of one pixel by cyan and magenta inks, as shown in FIG. 7, magenta dots 31M are formed at the front side of cyan dots 31C. That is, a color tone becomes to show magenta at the front side edge of the thin line and cyan at the back side edge, which results in that the color tone of the edge becomes reverse to that in FIG. 6.

Then, in order to suppress disunity in the color tone of the edges in the above thin lines, the ink jet printing apparatus 1 performs the later-mentioned nozzle correspondence relation determining process.

The later-mentioned nozzle correspondence relation determining process also considers the case where an abnormal head unit 21 other than the reversely-shifted head unit 21 shown in FIG. 5 is used. In more concrete terms, it is taken into consideration to use an abnormal head unit 21 in which, although an amount of shift between head modules 22U and 22D is not a half of a pitch, an amount of shift between the position of a nozzle 24 in the nozzle array 23U and the position of a nozzle 24 in the nozzle array 23D becomes a half of a pitch.

As such an abnormal head unit 21, there is a head unit in which head modules 22U and 22D are shifted from each other in the normal shift direction by (2M+1) times (M=1, 2, . . . ) a half of a pitch. Further, there is a head unit in which head modules 22U and 22D are shifted from each other in a direction reverse to the normal shift direction by (2M+1) times a half of a pitch. Here, the shift direction and an amount of shift between head modules 22U and 22D are the same as the shift direction and an amount of shift between nozzles 24 having the same nozzle number in the head modules 22U and 22D.

That is, if an amount of shift in the position of a nozzle 24 between the nozzle arrays 23U and 23D in a head unit 21 is a half of a pitch, such a head unit 21 may be included in the ink jet head 3 irrespective of the shift direction and an amount of shift between the head modules 22U and 22D.

In other words, if an amount of shift in the position of a nozzle 24 between the nozzle arrays 23U and 23D in a head unit 21 becomes a half of a pitch, the later-mentioned nozzle correspondence relation determining process is performed to enable such a head unit 21 to be used irrespective of the shift direction and an amount of shift between the head modules 22U and 22D.

Figure 8:
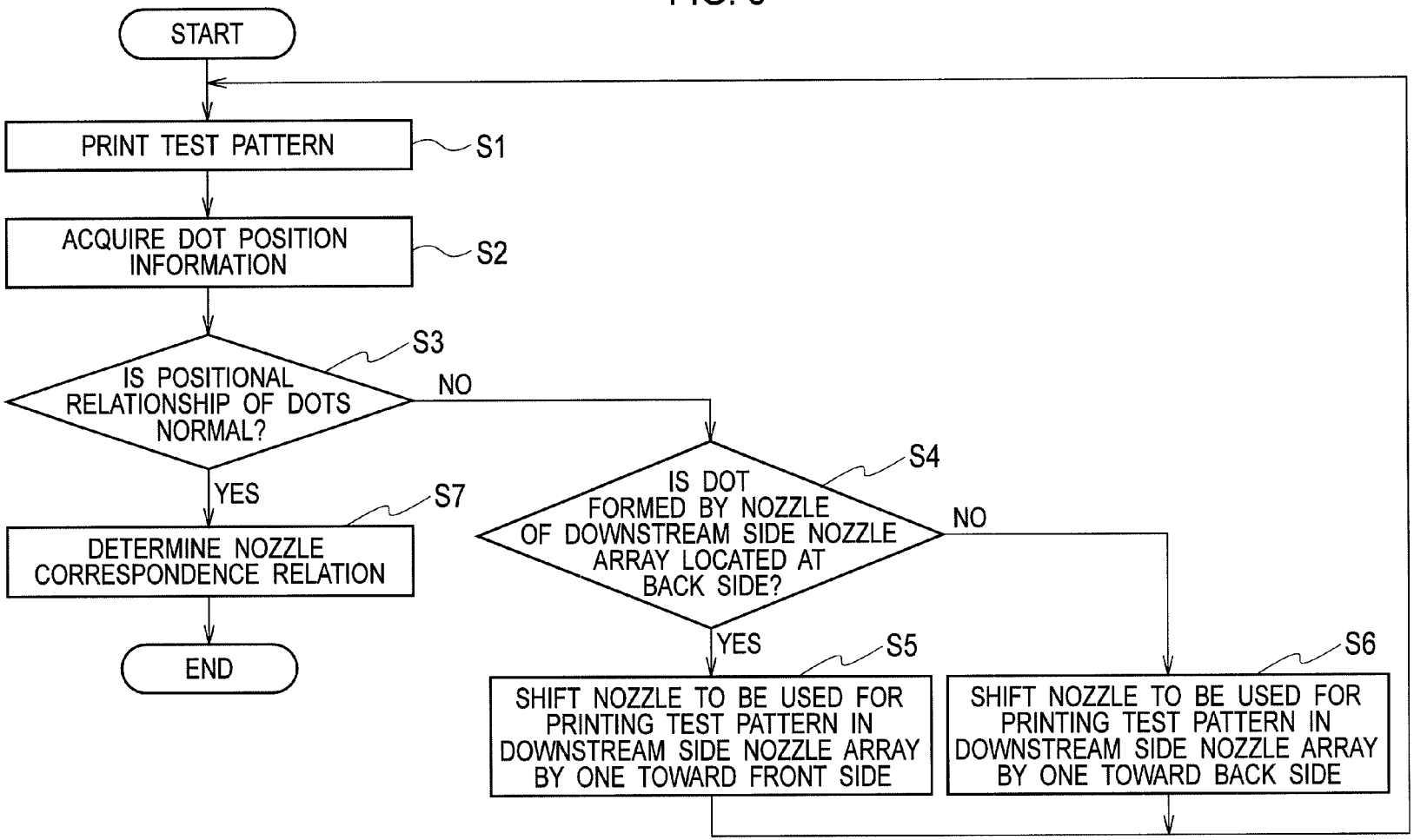
FIG. 8 is a flowchart of a nozzle correspondence relation determining process.

The nozzle correspondence relation determining process is described with reference to a flowchart shown in FIG. 8. Here, FIG. 8 shows a nozzle correspondence relation determining process for a single head unit 21. The controller 6 performs the nozzle correspondence relation determining process shown in FIG. 8 for each head unit 21. The nozzle correspondence relation determining process for each head unit 21 may be performed in parallel to the nozzle correspondence relation determining process for other head units 21.

Figure 9:
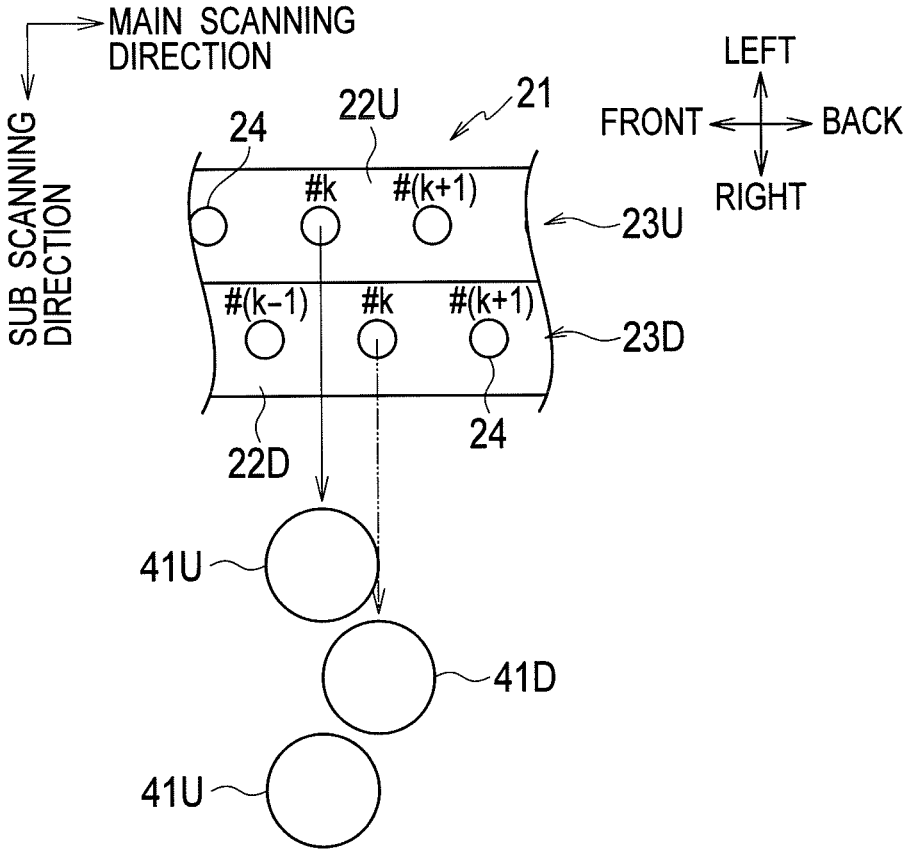
FIG. 9 is an explanatory diagram for a test pattern.

First, in Step S1 in FIG. 8, the controller 6 executes printing of a test pattern with a head unit 21 of a processing object. The test pattern is, for example, as shown in FIG. 9, a pattern in which dots 41U and 41D are formed alternately at positions shifted in the sub scanning direction with a single nozzle 24 in a nozzle array 23U at the upstream side and a single nozzle 24 in a nozzle array 23D at the downstream side.

In the printing of the first test pattern, the controller 6 makes ink ejected from each of the nozzles 24 having the same nozzle number in the nozzle arrays 23U and 23D so as to form dots 41U and 41D on a sheet PA.

Next, in Step S2, the controller 6 acquires the dot position information on the image of the printed test pattern. The dot position information is information which shows whether the dot 41U is positioned at a front side of the dot 41D in the main scanning direction and shows a distance between the centers of the dots 41U and 41D in the main scanning direction.

In more concrete terms, the controller 6 makes the image reader 5 read the images on the test pattern in response to an operation of a user for making the image reader 5 read a sheet PA on which the test pattern is printed. The image reader 5 reads the images on the test pattern, and generates image data. The controller 6 analyzes the image data of the test pattern and acquires the above-mentioned dot position information.

Here, a user may observe the images on the test pattern using a microscope or the like and input the obtained dot position information via an operation input section (not shown) so as to supply the dot position information to the controller 6.

Subsequently, in Step S3, the controller 6 determines based on the dot position information whether or not the positional relationship between the dots 41U and 41D is normal. In the case where the dot 41D is positioned at the back side of the dot 41U and a distance between the centers of the dots 41U and 41D in the main scanning direction is a half of a pitch (P/2), the controller 6 determines that the positional relationship between the dots 41U and 41D is normal.

When having determined that the positional relationship between the dots 41U and 41D is not normal (Step S3: NO), in Step S4, the controller 6 determines whether or not the dot 41D formed by the nozzle 24 in the nozzle array 23D at the downstream side is located at the back side of the dot 41U.

When having determined that the dot 41D is located at the back side of the dot 41U (Step S4: YES), in Step S5, the controller 6 shifts a nozzle 24 to be used for printing the test pattern in the nozzle array 23D at the downstream side by one toward the front side. In concrete terms, in the nozzle array 23D, when a nozzle 24 with a nozzle number of k was used for printing the test pattern at the last time, the nozzle number of a nozzle 24 to be used for printing the test patter at the next time is set to a nozzle number of (k−1). Thereafter, the controller 6 returns to Step S1.

When having determined that the dot 41D is located at the front side of the dot 41U (Step S4: NO), in Step S6, the controller 6 shifts a nozzle 24 to be used for printing the test pattern in the nozzle array 23D at the downstream side by one toward the back side. In concrete terms, in the nozzle array 23D, when a nozzle 24 with a nozzle number of k was used for printing the test pattern at the last time, the nozzle number of a nozzle 24 to be used for printing the test pattern at the next time is set to a nozzle number of (k+1). Thereafter, the controller 6 returns to Step S1.

In Step S3, when having determined that the positional relationship between the dots 41U and 41D is normal (Step S3: YES), in Step S7, the controller 6 determines the correspondence relation of the nozzle 24. In concrete terms, based on the nozzle number of the nozzles 24 in the nozzle arrays 23U and 23D which have been used for printing the test pattern in which the positional relationship between the dots 41U and 41D has been normal, the controller 6 determines the correspondence relation of the nozzles 24 in the nozzle arrays 23U and 23D.

For example, it is supposed that when nozzles 24 with a nozzle number of k in both the nozzle arrays 23U and 23D were used, the positional relationship between the dots 41U and 41D was normal. In this case, the controller 6 determines the correspondence relation such that nozzles 24 with the same nozzle number in the nozzle arrays 23U and 23D are used to form the same pixel.

Further, for example, it is supposed that when a nozzles 24 with a nozzle number of k in the nozzle array 23U and a nozzle 24 with a nozzle number of (k+1) in the nozzle array 23D were used, the positional relationship between the dots 41U and 41D was normal. In this case, the controller 6 determines the correspondence relation such that for each nozzle 24 in the nozzle array 23U, a nozzle 24 in the nozzle array 23D which has a nozzle number larger by one than the nozzle number of the corresponding nozzle 24 in the nozzle array 23U is used to form the same pixel.

With the above, the nozzle correspondence relation determining process has been completed. The controller 6 memorizes the nozzle correspondence relation in each head unit 21.

According to the nozzle correspondence relation determining process, the controller 6 determines the nozzle correspondence relation in each head unit 21 such that the positional relationship of nozzles 24 in the nozzle arrays 23U and 23D corresponding to the same pixel becomes the same for all the head units 21 irrespective of the positional relationship between nozzles 24 having the same nozzle number in the nozzle arrays 23U and 23D in each head unit 21.

In the example shown in FIG. 5, the correspondence relation is determined such that in the normal head unit 21 (the front side head unit 21) and the reversely-shifted head unit 21 (the backside head unit 21), a combination of nozzles 24 in the nozzle arrays 23U and 23D shown by being enclosed with a one dot chain line is used to form the same pixel. With this configuration, in the normal head unit 21 and the reversely-shifted head unit 21, the positional relationship of nozzles 24 used to form the same pixel in the nozzle arrays 23U and 23D becomes the same.

Next, the printing operation of the ink jet printing apparatus 1 is described.

When start of printing is instructed, the controller 6 rotationally drives the driving roller 12 of the conveyor 2. With this arrangement, the conveying belt 11 rotates. When a sheet PA is fed from a not-shown sheet feeder, the sheet PA is conveyed by the conveyor 2. The controller 6 makes ink ejected from ink jet heads 3A to 3C to the sheet PA conveyed by the conveyor 2 based on drop data. Thereby, an image is printed on the sheet PA.

At the time of printing operation, the controller 6 controls ink ejection from nozzles 24 to each pixel based on the correspondence relation of the nozzles 24 in the nozzle arrays 23U and 23D of each head unit 21 determined preliminarily by the nozzle correspondence relation determining process.

With this configuration, it becomes possible to unify the color tone of an edge of a thin line which is printed along the sub scanning direction with a width of one pixel with two color inks by the ink jet head 3 configured to eject two color inks. For example, with regard to a thin line which is printed along the sub scanning direction with a width of one pixel with two colors of cyan and magenta by the ink jet head 3B, in any thin line printed by any head unit 21B, as shown in FIG. 6, an edge at the front side becomes cyan and an edge at the back side becomes magenta.

Incidentally, in the ink jet printing apparatus 1, a thin line process can be selected. The thin line process is a process to unify the color tones of edges at both the front and back sides on a thin line which is printed along the sub scanning direction with a width of one pixel with two color inks by the ink jet head 3 configured to eject two color inks. The thin line process can be selected and set, for example, by an operation of a user on an operation input section (not shown).

The thin line process is described with reference to a flowchart shown in FIG. 10.

Figure 10:
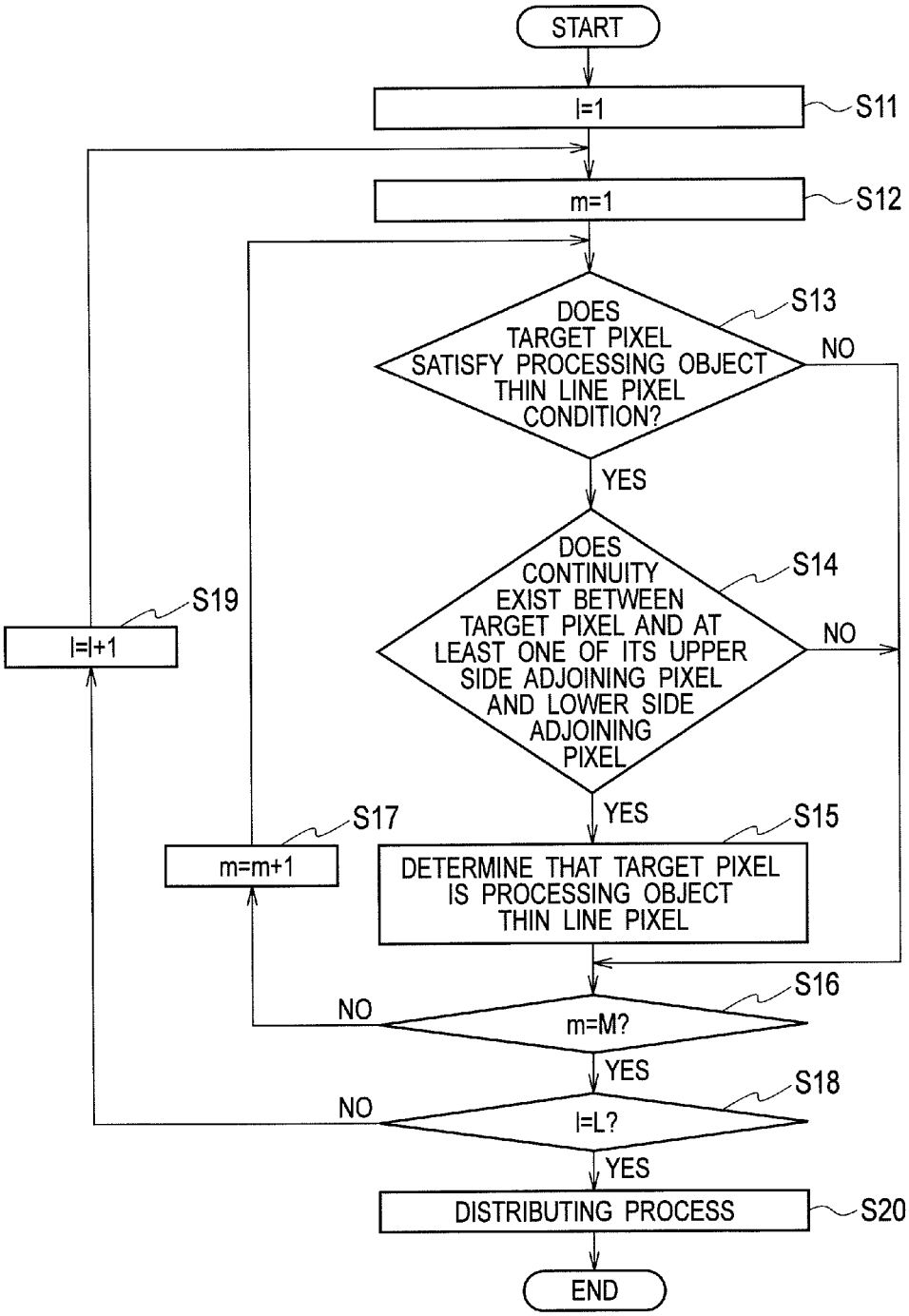
FIG. 10 is a flowchart of a thin line process.

First, in Step S11 in FIG. 10, the controller 6 sets "1" to a variable 1 which represents a line number in the drop data. Here, it is supposed that the first line in the drop data is set to the uppermost line and that as the line number of a line becomes larger, the line is a line at a lower side. The drop data are data which represent the number of drops of ink of each color to be ejected to each pixel.

Then, in Step S2, the controller 6 sets "1" to a variable m which represents a pixel number on a line. Here, it is supposed that a pixel at the left end on a line is set as the first pixel, and that as the pixel number of a pixel becomes larger, the pixel is positioned close to the right side.

Further, in Step S13, the controller 6 determines whether or not a target pixel which is the m-th pixel on the 1-th line satisfies a processing object thin line pixel condition.

The processing object thin line pixel condition is a condition for determining whether or not a target pixel is a candidate of a processing object thin line pixel. The processing object thin line pixel is a pixel which constitutes a processing object thin line which becomes an object for a distributing process in Step S20 mentioned later. The processing object thin line is a thin line with a width of one pixel which is printed along the sub scanning direction with two color inks by the ink jet head 3 configured to eject the two color inks. Here, the ink jet head 3 configured to eject two color inks is ink jet heads 3B and 3C. Further, it is supposed that a thin line along the vertical direction in the drop data is printed along the sub scanning direction.

In the case where, in a target pixel, in only two colors corresponding to the ink jet head 3 configured to eject the two color inks, the number of drops is not "0", and in the left side adjoining pixel and right side adjoining pixel of the target pixel, the number of drops in all colors is "0" controller 6 determines such that the target pixel satisfies the processing object thin line pixel condition. Here, the left side adjoining pixel of the target pixel is the (m−1)-th pixel on the 1-th line. The right side adjoining pixel of the target pixel is the (m+1)-th pixel on the 1-th line.

For example, in the case where, in a target pixel, in only two colors of cyan and magenta corresponding to the ink jet head 3B, the number of drops is not "0", and in the left side adjoining pixel and right side adjoining pixel of the target pixel, the number of drops in all colors is "0", the controller 6 determines such that the target pixel satisfies the processing object thin line pixel condition.

Further, for example, in the case where, in a target pixel, in only two colors of yellow and an additional color corresponding to the ink jet head 3C, the number of drops is not "0", and in the left side adjoining pixel and right side adjoining pixel of the target pixel, the number of drops in all colors is "0", the controller 6 determines such that the target pixel satisfies the processing object thin line pixel condition.

Here, when there is no left side adjoining pixel of the target pixel, i.e., when m=1, the controller 6 deems that the number of drops in all the colors in the left side adjoining pixel of the target pixel is "0". Similarly, when there is no right side adjoining pixel of the target pixel, i.e., when m=M, the controller 6 deems that the number of drops in all the colors in the right side adjoining pixel of the target pixel is "0". Here, M is the pixel number of the last pixel (right end pixel) on one line.

When having determined that the target pixel does not satisfy the processing object thin line pixel condition (Step S13: NO), the controller 6 proceeds to Step S16.

When having determined that the target pixel satisfies the processing object thin line pixel condition (Step S13: YES), in Step S14, the controller 6 determines whether or not continuity exists between the target pixel and at least one of its upper side adjoining pixel and its lower side adjoining pixel. Here, the upper side adjoining pixel of the target pixel is the m-th pixel on the (l−1)-th line. The lower side adjoining pixel of the target pixel is the m-th pixel on the (l+1)-th line.

When the upper side adjoining pixel of the target pixel also satisfies the processing object thin line pixel condition and the number of drops of each color is the same in the target pixel and its upper side adjoining pixel, the controller 6 determines such that continuity exists between the target pixel and its upper side adjoining pixel. Similarly, when the lower side adjoining pixel of the target pixel also satisfies the processing object thin line pixel condition and the number of drops of each color is the same in the target pixel and its lower side adjoining pixel, the controller 6 determines such that continuity exists between the target pixel and its lower side adjoining pixel.

Further, when there is no upper side adjoining pixel of the target pixel, i.e., when l=1, the controller 6 determines such that continuity does not exist between the target pixel and its upper side adjoining pixel. Also, when there is no lower side adjoining pixel of the target pixel, i.e., when l=L, the controller 6 determines such that continuity does not exist between the target pixel and its lower side adjoining pixel. Here, L is the line number of the last line (the lowermost side line).

When having determined that continuity does not exist between the target pixel and any one of its upper side adjoining pixel and lower side adjoining pixel (Step S14: NO), the controller 6 proceeds to Step S16.

When having determined that continuity exists between the target pixel and at least any one of its upper side adjoining pixel and lower side adjoining pixel (Step S14: YES), in Step S15, the controller 6 determines such that the target pixel is the processing object thin line pixel.

Then, in Step S16, the controller 6 determines whether or not m=M holds.

When having determined that m=M does not hold (Step S16: NO), in Step S17, the controller 6 adds "1" to the variable m. Thereafter, the controller 6 returns to Step S13.

When having determined that m=M holds (Step S16: YES), in Step S18, the controller 6 determines whether or not l=L holds.

When having determined that l=L does not hold (Step S18: NO), in Step S19, the controller 6 adds "1" to the variable l. Thereafter, the controller 6 returns to Step S12.

When having determined that l=L holds (Step S18: YES), in Step S20, the controller 6 executes the distributing process. The distributing process is a process which distributes the number of drops (an amount of ejected ink) of the ink of any one color of the two colors in the processing object thin line pixel to the left side adjoining pixel or the right side adjoining pixel of the processing object thin line pixel.

As a color in which the number of drops is distributed, any one of the two colors may be permissible. When a thin line is printed, the controller 6 determines the pixel of a distributing destination such that one color in which the number of drops has been distributed sandwiches the other color. The controller 6 distributes about a half of the number of drops of one color set against the processing object thin line pixel in the drop data as the number of drops of one color in the pixel of the distributing destination.

Figure 11:
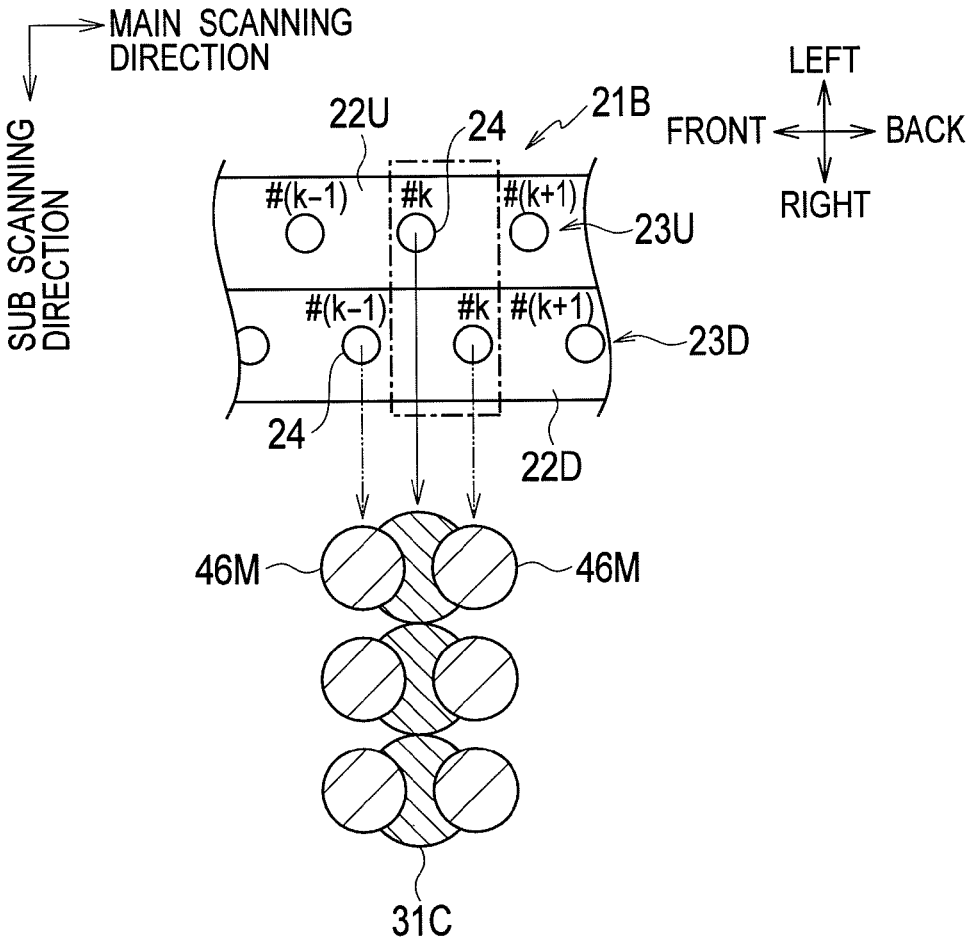
FIG. 11 is an illustration showing the dot images of a thin line printed after having been subjected to a thin line process.

For example, in the case of printing a thin line along the sub scanning direction with two colors of cyan and magenta by the head unit 21B of the ink jet head 3B, the controller 6 distributes the number of drops of magenta so as to print a thin line as shown in FIG. 11.

In FIG. 11, the k-th nozzles 24 in the nozzle arrays 23U and 23D enclosed with a one dot chain line correspond to a pixel (a processing object thin line pixel) of a thin line. The (k−1)-th nozzles 24 in the nozzle arrays 23U and 23D which adjoin to the front side of the pixel in this thin line in the main scanning direction corresponds to a pixel at the distributing destination.

A cyan dot 31C is formed with the ink ejected from the k-th nozzle 24 in the nozzle array 23U. Further, magenta dots 46M are formed at the front side and back side of the cyan dot 31C with the inks ejected respectively from the k-th nozzle 24 and the (k−1)-th nozzle 24 in the nozzle arrays 23D. Since the magenta dots 46M are formed with the number of drops smaller than the number of drops of magenta set for the processing object thin line pixel in the drop data, the thickness of a thin line is suppressed.

Further, in FIG. 11, a pixel adjoining the backside of a pixel of a thin line in the main scanning direction may be set as a pixel of the distributing destination. In this case, the (k+1)-th nozzles 24 in the nozzle arrays 23U and 23D correspond to a pixel of the distributing destination, and the number of drops of cyan ink is distributed. In this case, with ink ejected from the k-th nozzle in the nozzle array 23D, a magenta dot is foamed. Further, with ink ejected from the k-th nozzle 24 and the (k+1)-th nozzle 24 in the nozzle array 23U, cyan dots are formed at the front side and back side of the magenta dot.

As can be understood from the description based on the above-mentioned FIG. 11, when a thin line process has been performed, a thin line is printed with inks ejected from nozzles 24 corresponding to the pixels of the thin line and nozzles 24 on a side near to the pixels of the thin line among the nozzles 24 corresponding to pixels adjoining the front side or the back side in the main scanning direction for the pixels of the thin line. With this configuration, a thin line is printed such that one color sandwiches the other color. As a result, the color tones of edges at both the front and back sides can be unified.

As described above, in the ink jet printing apparatus 1, the controller 6 determines the nozzle correspondence relation in each head unit 21 such that the positional relationship of nozzles 24 in each of the nozzle arrays 23U and 23D corresponding to the same pixel becomes the same for all of the head units 21 irrespective of a positional relationship between nozzles 24 having the same nozzle number in the nozzle arrays 23U and 23D in each head unit 21. With this configuration, even if the ink jet head 3 configured to eject two color inks includes a reversely-shifted head unit 21, the color tones of edges on a thin line which is printed with the two color inks along the sub scanning direction with a width of one pixel can be unified. As a result, it becomes possible to suppress the lowering of the printing quality of a thin line.

Further, in the ink jet printing apparatus 1, a thin line process can be selected. If the thin line process is performed, the respective color tones of edges at both the front and back sides on a thin line which is printed with two color inks along the sub scanning direction with a width of one pixel by the ink jet head 3 configured to eject the two color inks can be unified. With this configuration, it becomes possible to enhance the printing quality of a thin line.

In the above-mentioned embodiment, description is given to the case where the head unit 21 includes the two nozzle arrays 23U and 23D. However, the present invention can be applied also to the case where the head unit 21 includes the or more nozzle arrays which eject color inks different from one another.

Also in this case, as same as the above-mentioned thin line process, the number of drops of a part of color inks is distributed from a pixel on a thin line to adjoining pixels, whereby a thin line may be printed by ejecting inks from each nozzle corresponding to pixels of the thin line and from each nozzle on a side near to the pixels of the thin line among the nozzles corresponding to pixels adjoining one side in the nozzle arrangement direction for the pixels of the thin line. With this configuration, the color tones of edges at both the front and back sides on a thin line which is printed in the sub scanning direction with a width of one pixel by multiple colors, can be unified.

Further, even in the case where an amount of shift in the position of a nozzle between nozzle arrays is not a half of a pitch, by determining a nozzle correspondence relation in the nozzle correspondence relation determining process of the present embodiment, the color tones of edges on a thin line which is printed in the sub scanning direction with a width of one pixel by multiple colors, can be unified.

Further, in the above-mentioned embodiment, the description is given to the head unit in which two head modules are stuck to each other. However, without being limited to the above example, the present invention can be applied to the configuration in which multiple nozzle arrays are arranged in a single head unit.

Figure 12:
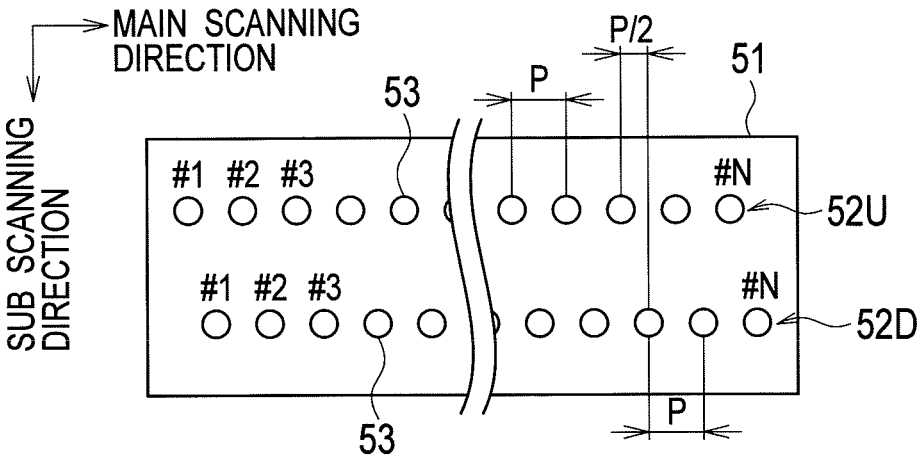
FIG. 12 is an explanatory diagram of another example of the head unit.

For example, the present invention can be applied also to an ink jet printing apparatus employing a head unit 51 shown in FIG. 12.

The head unit 51 includes nozzle arrays 52U and 52D formed on the same nozzle plate. Each of the nozzle arrays 52U and 52D is configured by a plurality of nozzles 53. In each of the nozzle arrays 52U and 52D, the nozzles 53 are arranged with an equal interval at a predetermined pitch P along the main scanning direction. Then, the nozzles 53 in the nozzle array 52U and the nozzles 53 in the nozzle array 52D are arranged so as to be shifted by a half of a pitch (P/2) from each other in the main scanning direction. The nozzle arrays 52U and 52D are enabled to eject color inks different from each other.

In the head unit 51, a reverse shift due to shift at the time of stacking the head modules 22U and 22D as with the head unit 21 in the above-mentioned embodiment does not occur. However, due to failures at the time of production of the head unit 51, for example, as shown in FIG. 13, there may be a case where a nozzle 53 does not open at a position where the nozzle 53 with a nozzle number of 1 in the nozzle array 52U originally exists.

Figure 13:
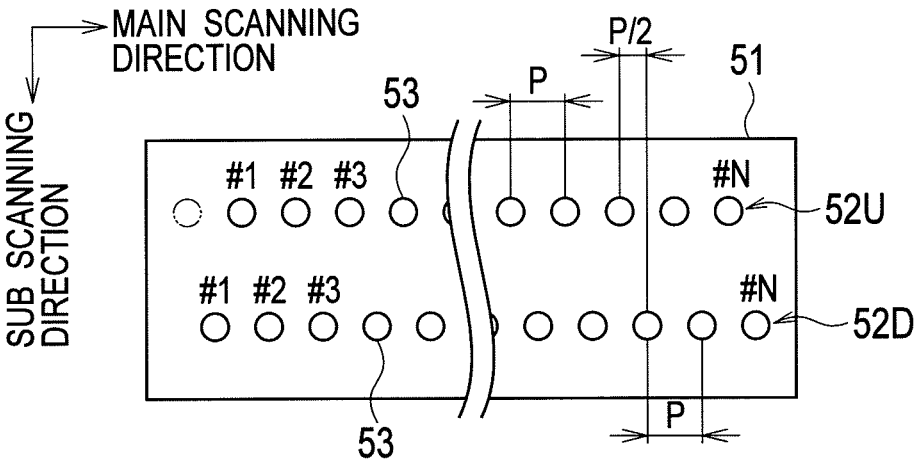
FIG. 13 is an explanatory diagram for the head unit in which a part of nozzles do not open.

In such a head unit 51, as shown in FIG. 13, the nozzle number of a nozzle 53 with an original nozzle number of 2 in the nozzle array 52U becomes No. 1. For this reason, the head unit 51 in FIG. 13 corresponds to the reversely-shifted head unit 21 in the above-mentioned embodiment. Therefore, the head units 51 in FIG. 12 and FIG. 13 can be handled similarly to the head unit 21 in the above-mentioned embodiment.

Further, in the above-mentioned embodiment, the description is given to the line type ink jet printing apparatus configured to print with a fixed ink jet head. However, the present invention can be applied also to a serial type ink jet printing apparatus configured to perform printing while moving an ink jet head.

The present invention should not be limited to the above-mentioned embodiment as it is, and in an implementing stage, the present invention can be embodied by modifying constituent elements in a range not deviating from its gist. Further, various inventions can be formed with a proper combination of multiple constituent elements disclosed in the above-mentioned embodiment. For example, some constituent elements may be omitted from all the constituent elements disclosed in the above-mentioned embodiment.

This application claims the priority right based on Japan Patent Application No. 2013-193045 filed on Sep. 18, 2013, the entire contents of the application are incorporated herein by reference.

INDUSTRIAL APPLICABILITY

According to the ink jet printing apparatus related to the present invention, the controller determines a nozzle correspondence relationship in multiple nozzle arrays in each head unit so that the positional relationship among nozzles in each nozzle array corresponding to the same pixel becomes the same in all of the head units irrespective of the positional relationship between nozzles having the same number in order from one side in the nozzle arrangement direction in the multiple nozzle arrays in each head unit. With this configuration, even if the ink jet head includes a reversely-shifted head unit, the color tones of edges in a thin line which is printed along the sub scanning line with a width of one pixel by multiple colors can be unified. As a result, deterioration of the printed image quality of a thin line can be suppressed.

What is claimed is:

1. An ink jet printing apparatus comprising:

an ink jet head including a plurality of head units each having a plurality of nozzle arrays arranged, each of which has a plurality of nozzles arranged at a predetermined pitch in a nozzle arrangement direction and which is configured to eject color inks different from one another from the nozzles, the plurality of head units being arranged in the nozzle arrangement direction; and a controller configured to control the ink jet head, wherein in each of the head units, at least one of the plurality of nozzle arrays is arranged so that a position of each of the nozzles is shifted in the nozzle arrangement direction relative to at least one of the other nozzle arrays, and wherein the controller determines a correspondence relationship among nozzles in the plurality of nozzle arrays in each of the plurality of head units so that a positional relationship among nozzles corresponding to the same pixel in each of the plurality of nozzle arrays becomes the same in all of the plurality of head units irrespective of a positional relationship among nozzles having the same number in order from one side in the nozzle arrangement direction in the plurality of nozzle arrays in each of the plurality of head units.

2. The ink jet printing apparatus according to claim 1, wherein in the head unit, an amount of shift between the nozzle arrays in which the position of each of the nozzles in the plurality of nozzle arrays is shifted from one another is a half of a pitch, and wherein when printing a thin line with a width of one pixel on a sheet in a direction perpendicular to the nozzle arrangement direction by each of the color inks corresponding to the plurality of nozzle arrays including the nozzle array in which the position of each of the nozzles is shifted in the nozzle arrangement direction, the controller prints by ejecting inks from each of the nozzles corresponding to pixels of the thin line and each of the nozzles on a side near to the pixels of the thin line among the nozzles corresponding to pixels adjoining one side in the nozzle arrangement direction with respect to the pixels of the thin line.

* * * * *